US005335713A

United States Patent [19]

Hoppmann et al.

[11] Patent Number: 5,335,713

[45] Date of Patent: Aug. 9, 1994

[54] INSTALLATION FOR THE MANUFACTURE OF HOT-ROLLED STEEL STRIP

[75] Inventors: Hans-Dieter Hoppmann, Düsseldorf; Klaus Frommann, Meerbusch, both of Fed. Rep. of Germany

[73] Assignee: Mannesmann Aktiengesellschaft, Dusseldorf, Fed. Rep. of Germany

[21] Appl. No.: 582,497

[22] Filed: Sep. 14, 1990

[30] Foreign Application Priority Data

Mar. 17, 1988 [DE] Fed. Rep. of Germany ..... 3809681

[51] Int. Cl.[5] ..... B22D 45/00

[52] U.S. Cl. ..... 164/441; 164/476; 164/269; 29/527.7; 242/403; 242/407

[58] Field of Search ..... 164/476, 477, 269, 418, 164/441; 29/527.6, 527.7; 242/78.1, 78.7, 79

[56] References Cited

U.S. PATENT DOCUMENTS

| | | | |
|---|---|---|---|
| 2,327,906 | 8/1943 | Kiefer | 242/79 |
| 4,123,011 | 10/1978 | Kajiwara et al. | 242/79 |
| 4,630,352 | 12/1986 | Ginzburg et al. | 29/527.7 |
| 4,698,897 | 10/1987 | Frommann et al. | 29/527.7 |
| 4,817,703 | 4/1989 | Rohde et al. | 164/476 |

FOREIGN PATENT DOCUMENTS

| | | | |
|---|---|---|---|
| 1954675 | 5/1971 | Fed. Rep. of Germany | 242/78.6 |
| 121809 | 7/1982 | Japan | 29/527.7 |
| 127145 | 6/1987 | Japan | 164/477 |

*Primary Examiner*—Paula A. Bradley
*Assistant Examiner*—Rex E. Pelto
*Attorney, Agent, or Firm*—Cohen, Pontani, Lieberman, Pavane

[57] ABSTRACT

In an installation for the manufacture of hot-rolled steel strip from continuously cast stock, a caster for the continuous casting of the stock into steel strip, a furnace positioned for receiving the strip after it leaves the caster and containing at least two winding/unwinding mandrels each placed in first and second proximate locations, respectively, the first mandrel is placed in the first location adapted to receive and wind the strip into a coil, transport devices are provided for transporting the coil and first mandrel from the first location to a second location and the second mandrel from the second location to the first location; the strip is unwound from the first mandrel in said second location and then fed to a mill. Alternative embodiments include vertical or horizontal movement of the mandrels, more than two mandrels, devices for driving the mandrels at different speeds, cutting means, clamping devices, furnace heating devices, dividing shears and descaling.

14 Claims, 3 Drawing Sheets

INSTALLATION FOR THE MANUFACTURE OF HOT-ROLLED STEEL STRIP

FIELD OF THE INVENTION

The present invention relates to an installation for the manufacture of hot-rolled steel strip from continuously cast stock, in which the casting leaves the caster and is reeled in a reeling station to form a coil, the coil is then transferred to another reeling station and then unreeled as a strip which is fed into a rolling mill. The reeling stations are arranged in a common furnace.

BACKGROUND OF THE INVENTION

Such installations are known to be advantageous in cost savings, since hot-rolled strip continuously produced from cast stock uses considerably less energy as a consequence of the elimination of reheaters (of the slabs), intermediate transporters, and storage places present in traditional installations. Continuous casting installations are further advantageous in that they produce castings that are already in strips with a reduced cross section. This shape eliminates the high expense and greater energy required for deformation of larger shapes, as well as renders possible the winding of the continuous casting into coils directly after the continuous caster. This winding or coiling ability of the casting is utilized by the invention described below, since the maximum rate that a continuous casting can achieve as it leaves the continuous caster is much less than the lowest possible speed of rolling of traditional roll stands.

It was therefore proposed in basic German Patent No. 32 41 745 C2 that the continuous casting be wound into a coil (without a mandrel) in a furnace, that the coil be transferred, then unwound discontinuously and fed into a rolling mill. For the winding, a mandrel-less device is used, known as a "coil box." The coil box is used for winding the relatively thick, continuous castings.

However, such a prior art installation, i.e., with mandrel-less reeling stations arranged within the furnace, is unfavorable from a structural standpoint and is very expensive. Furthermore, mandrel-less winding can be considered reliable only when the continuous castings are relatively thick.

SUMMARY OF THE INVENTION

In light of the foregoing, it is an object of the present invention to improve the arrangement of the reeling stations within the furnace in order to enable easy reeling and unreeling of the cast strip, at times to provide intermediate storage of the coils, and to simplify transfer of the coil.

These and other objectives are achieved by the provision of an installation for the manufacture of hot-rolled steel strip from continuously cast stock having a furnace placed in the path of the casting as it moves from caster to mill, in which the furnace has at least two winding-/unwinding mandrels placed in a first and second location proximate one another. The continuous casting, after it leaves the caster, is wound into a coil in the first mandrel in the first location, the now full first mandrel is transferred to a second location while another winding/unwinding mandrel that had occupied the second location is transferred to the first location. While the first mandrel is unwound, the second mandrel reel winds another length of casting from the caster.

Thus, the invention further involves means for transport of winding mandrels over a path of revolution which extends horizontally or vertically in a single plane.

Differing from the prior art, the winding mandrels revolve herein so that even continuously cast strip which cannot be wound on mandrel-less winding devices can now be wound and transferred.

In order to solve the problem of space required and consumption of heat, in accordance with another embodiment of the invention, the winding mandrels revolve with the furnace around a vertical axis.

In another embodiment of the invention, the path of revolution of the winding mandrels is closed upon itself and extends in a vertical plane and the winding mandrels are moveable stepwise.

Particularly in the case of vertically revolving winding mandrels, it is preferred that more than two winding mandrels be moveable simultaneously in a path of revolution, and preferably moveable over a circular path. It will not deviate from the scope of the invention, and indeed in light hereof it is conceivable to provide a different self-contained path of movement if the plane of revolution is vertical.

The invention thus renders possible and favorable the driving of the winding mandrel in each case in the winding and unwinding stations.

In another embodiment of the invention, the winding mandrels are driven independently of each other and the drives, which are fixed relative to the path of revolution of the winding mandrels, are detachably connected to the winding mandrels. This is advisable since the winding mandrels, due to the different speeds for the reeling and unreeling, must operate with different drive speeds. The winding mandrels can also be brought stepwise into the specific winding position and be coupled there with the drives.

If the temperature of the continuous casting is not sufficient for reeling or rolling, it is contemplated, in accordance with another embodiment of the invention, that a device for the controlled heating of the cast strand to a temperature sufficient to reel or roll be provided in front of and/or behind the furnace. Such devices can, of course, be eliminated when the temperature of the furnace permits rolling without reheating or the temperature of the cast strand corresponds to the reeling temperature.

In the event that the winding mandrels are turnable together with the furnace around a vertical axis, then, in accordance with another embodiment of the invention, clamping devices are provided for the starting and terminating ends of the strip in the region of the inlet and outlet openings of the furnace. These clamping devices hold the ends of the strip until completion of the revolution of the winding mandrel from the winding location to an unwinding location, to enable easy rethreading of the end of the strip, which then becomes the starting end, in the unwinding process.

In the embodiment containing clamping devices, the end, either starting or terminating depending upon location of the mandrel in the furnace, may cool. Consequently, in yet another embodiment, means for cutting off the cold starting end of the strip are provided.

In accordance with still another embodiment of the invention, a gas-tight feed line for a furnace heating gas, which is stationary with respect to the furnace, is provided for the heating of the furnace.

In order to rotate the furnace, in another embodiment, the furnace is moveable on a turntable or turnable rim.

In one particularly favorable embodiment of the invention in which the mandrels move in a vertical path of revolution, the mandrels are placed in the inlet-side reel furnace of a Steckel mill. The unwinding reeling station can be used for the multiple reeling and unfeeling of the strip which is rolled in reversing passes and therefore in the manner of a Steckel furnace, such as is known with only one reeling station.

In a final embodiment, transverse dividing shears are arranged in known manner in front of the winding mandrels and/or descaling means are arranged in place of the shears or behind them. The transverse dividing shears are necessary if the weight of the continuous casting is greater than the coil weight of the coil present in the winding reeling station. Means for descaling are, as a rule, required behind the furnace in order to prevent the scale from being rolled into the material in the mill.

BRIEF DESCRIPTION OF THE DRAWINGS

Other objects and features of the present invention will be readily appreciated and better understood by reference to the detailed description and drawings in which like-referenced numerals designate like parts throughout, and wherein.

DETAILED DESCRIPTION OF THE INVENTION

Figure 1:
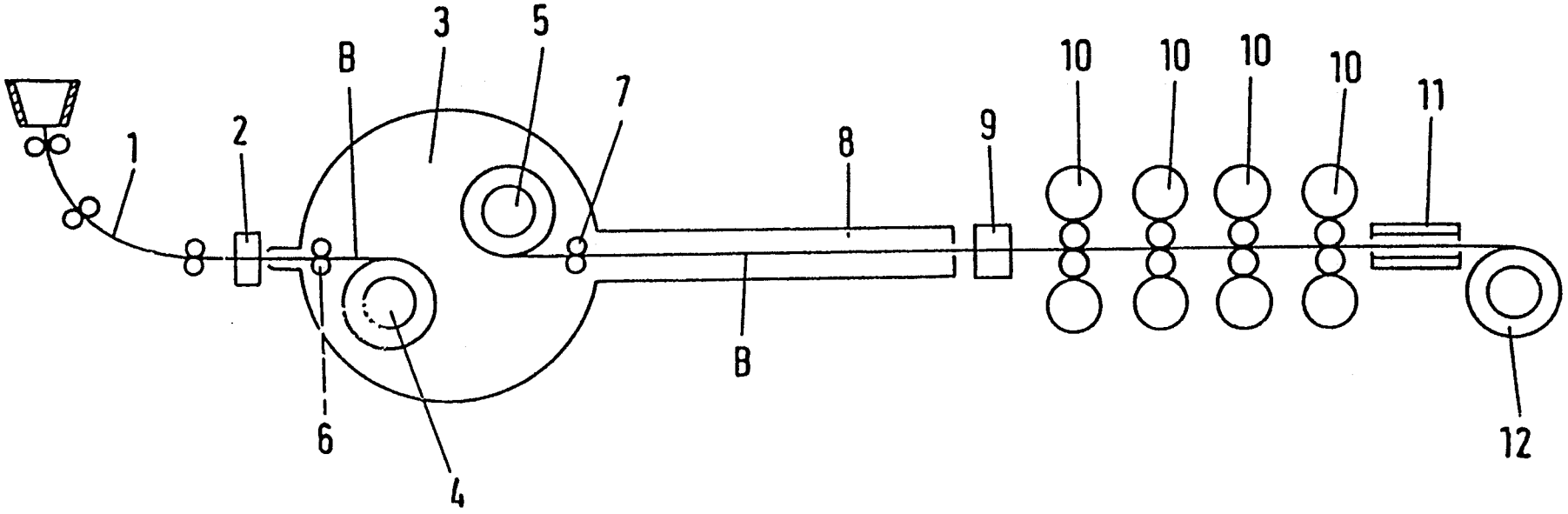
FIG. 1 shows a greatly simplified overview of an installation for the manufacture of hot-rolled steel strip, having a furnace in accordance with the invention.

In FIG. 1, in continuous casting installation 1, continuous casting B passes through shears 2 before it is introduced by means of a driver 6 into a furnace 3 and reeled on a winding mandrel 4.

Figure 2:
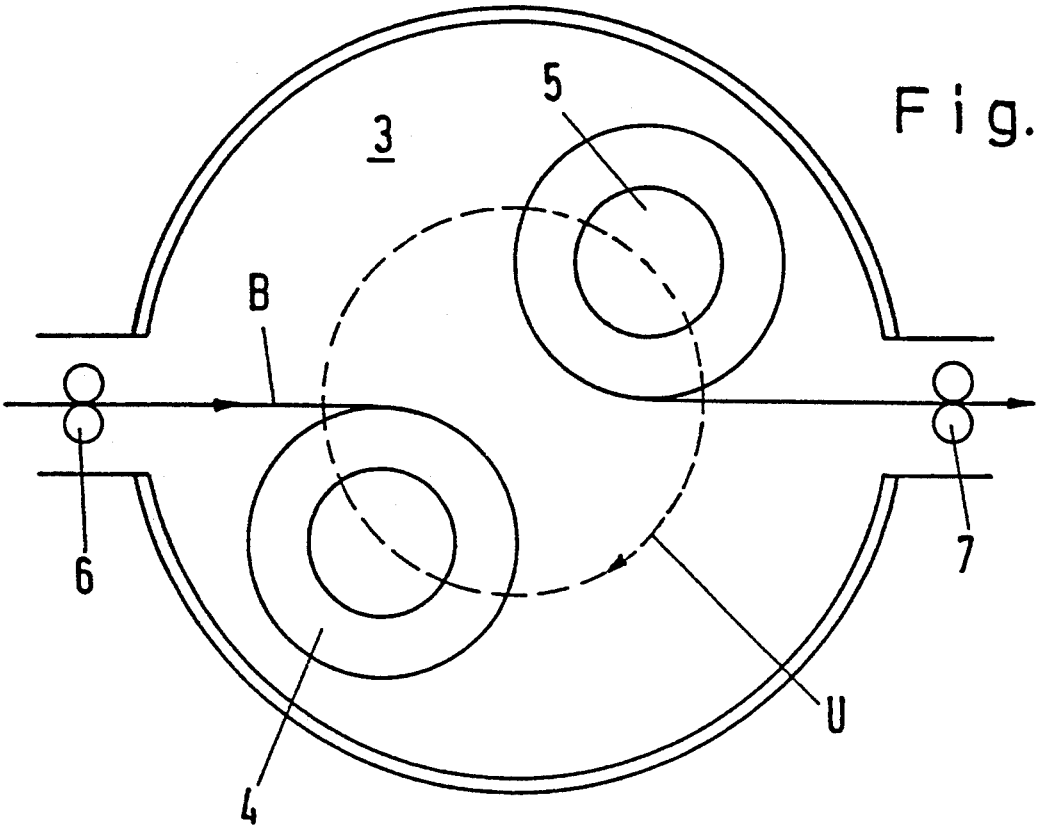
FIG. 2 is a larger scale view of the furnace of the invention shown in FIG. 1.

As shown on a larger scale in FIG. 2, winding mandrel 4, occupying a first location, is carried in the direction of the arrow in a circular path of revolution U (shown in dashed line) into a second location, shown in FIG. 2 as being occupied by a winding mandrel 5. As mandrel 4 moves into the second location, mandrel 5 moves into the first location originally occupied by mandrel 4. In this way, mandrels 4 and 5 swap locations, as shown in FIG. 2. In the second location, cast bar B is unwound from mandrel 4 (now in the location of mandrel 5) by means of a drive apparatus 7. Bar B is then fed through a heating apparatus 8, next through a scale-removing device 9 and finally to a mill 10. From mill 10, the strip is cooled in a cooling path 11 before it is reeled in a reel 12.

Figure 3:
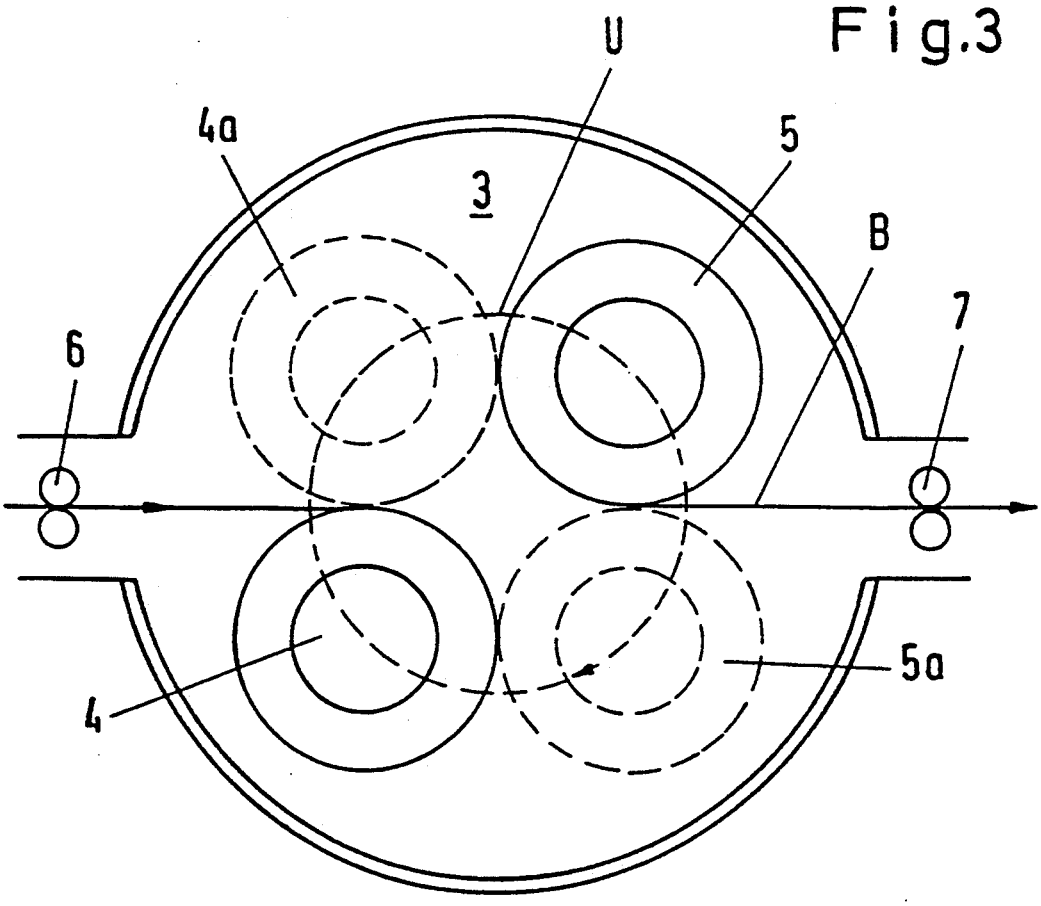
FIG. 3 shows the furnace of FIG. 4 with four winding mandrels.

FIG. 3 shows an alternative embodiment in which four winding mandrels 4, 4*a*, 5, 5*b* are arranged for movement in a path of revolution U. The winding mandrels are at equal distances apart and permit intermediate storage of wound coils in the stations 4*a* and 5*a*.

In another embodiment (not shown in the drawings), a device for the heating of the continuous casting can also be located between continuous casting installation 1 and furnace 3; it can also be a special device solely for the heating of the edges of the strip.

Figure 4:
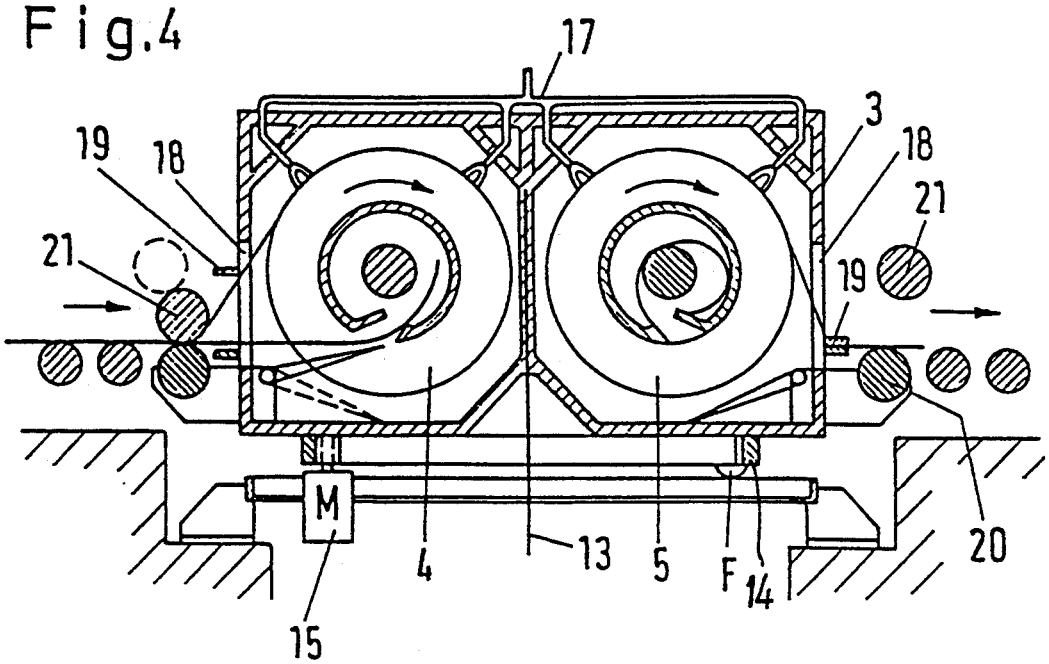
FIG. 4 shows a furnace, rotatable around a vertical axis, with integrated winding mandrels.

The embodiment of the invention shown in FIG. 4 is particularly favorable since the furnace 3 can be kept small. As a consequence, the amount of heating gas used is slight, which is important for a favorable energy balance. As shown in the arrangement in FIG. 4, winding mandrels 4, 5 are fixed in place within the furnace 3 while the furnace 3 itself is turnable around a vertical axis 13. For this purpose, the furnace 3 is mounted on guide rollers F on a rotary rim 14 and is moved by a fixed drive 15 which corresponds with a gear rim 16. In the upper region of the furnace 3 there is a gas feed 17 which can take place, for instance, via a known rotary lead-through. On the inlet side of furnace 3, i.e., the left side of FIG. 4, a clamping device 19 is situated within the opening region of furnace 3, for the end 20 of the strip. Clamping device 19 holds the end 20 of the strip during rotation of the furnace 3 by 180° thus transporting the coil from the first, winding location to the second, unwinding location. By means of a driver 21, the end of the coil which is held fast by clamping device 19, now representing the starting end of the coil for unwinding, is fed to a cutting device (not shown) which cuts off this starting end of the strip which has become cold outside the furnace.

Figure 5:
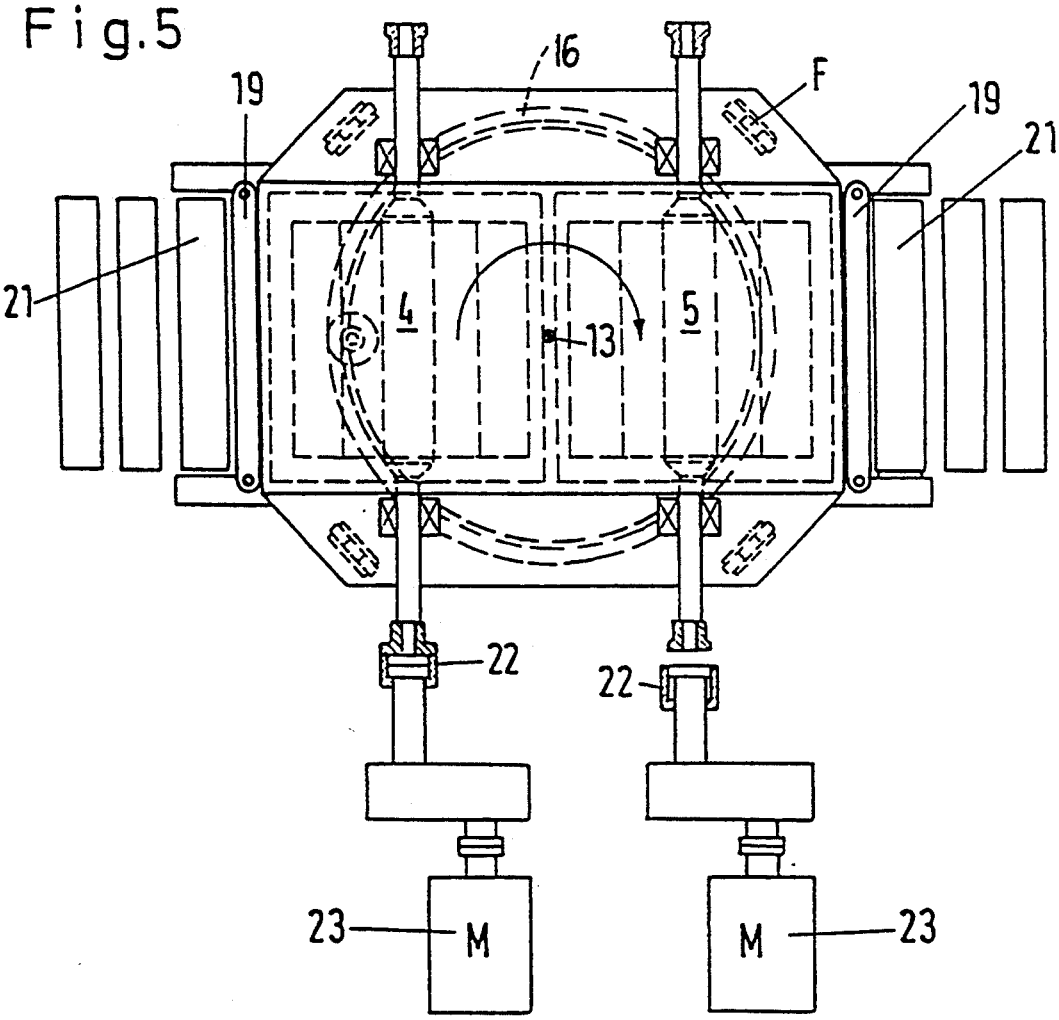
FIG. 5 is a top view of the furnace of FIG. 4.

As shown in the top view of FIG. 5, the shafts of the winding mandrels 4, 5 are extended out of the furnace 3 on both sides thereof and provided with couplings 22 for the stationary drives. After the furnace swings from winding to unwinding positions, the couplings can optionally be engaged or disengaged on one or the other side of the winding mandrels 4, 5 so that the winding mandrels 4, 5 can readily be driven with different speeds. The furnace 3 can always be turned by, in each case, 180° in the same direction or alternately in one or the other direction.

While there have been shown and described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

We claim:

1. An installation for the manufacture of hot-rolled steel strip from continuously cast stock, comprising:

a caster for the continuous casting of the stock into steel strip;

a furnace positioned for receiving the strip after it leaves the caster;

said furnace containing at least two winding/unwinding mandrels placed in proximate locations, respectively;

a first mandrel in a first location adapted to receive and wind the strip into a coil;

transport means positioned within said furnace for transporting the coil and said first mandrel from said first location to a second location and a second mandrel from said second location to said first location, said transport means defining a path of revolution located in a single plane; and receiving means proximate said furnace for unwinding the strip from said first mandrel in said second location and feeding the strip to a mill, said mandrels being turned with the furnace around a vertical axis.

2. The installation of claim 1, wherein the path of revolution is a closed path and extends in a vertical plane, and the mandrels are moveable stepwise.

3. The installation of claim 2, wherein additional mandrels are positioned in said furnace proximate to one another, such that all mandrels can be moved simultaneously in the path of revolution.

4. The installation of claim 2, wherein said path is circular.

5. The installation of claim 2, wherein said furnace includes an inlet-side reel, and said mandrels are arranged in said inlet-side reel.

6. The installation of claim 1, wherein additional mandrels are positioned in said furnace proximate to one another, such that all mandrels can be moved simultaneously in the path of revolution.

7. The installation of claim 1, wherein said mandrels are each provided with driving means for at least each of the winding and unwinding locations.

8. The installation of claim 1, wherein each of the mandrels is driven by a drive means, the drive means of the mandrels being independent of one another, said drive means fixed relative to said path of revolution, and detachably coupled to said mandrels.

9. The installation of claim 1, wherein the furnace is further provided with heating means for the controlled heating of the continuous casting to a winding or a cooling temperature.

10. The installation of claim 1, wherein said furnace further comprises inlet and outlet opening regions, and clamping means are provided in each of said inlet and outlet opening regions, respectively, for clamping the strip starting and terminating ends.

11. The installation of claim 1, wherein the coil has a cold starting end, further comprising cutting means for eliminating the cold starting end of the coil, said cutting means positioned proximate said furnace.

12. The installation of claim 2, further comprising means for moving said furnace, said means including a rotatable disk or rim.

13. The installation of claim 1, wherein said mandrels are positioned to receive the strip after the strip has passed through dividing shears.

14. The installation of claim 1, wherein said mandrels are positioned to receive the strip after the strip has passed through dividing shears, and before said strip passes through means for descaling.

* * * * *